United States Patent [19]

Hundertmark

[11] Patent Number: 4,590,897

[45] Date of Patent: May 27, 1986

[54] IDLE FUEL RESIDUAL STORAGE SYSTEM

[75] Inventor: James M. Hundertmark, Fond du Lac, Wis.

[73] Assignee: Brunswick Corp., Skokie, Ill.

[21] Appl. No.: 670,390

[22] Filed: Nov. 13, 1984

[51] Int. Cl.[4] ..... F02B 33/04; F02M 25/00

[52] U.S. Cl. ..... 123/73 A; 123/73 V

[58] Field of Search ..... 123/73 R, 73 A, 73 AD, 123/73 V, 73 SP, 73 SC, 196 CP

[56] References Cited

U.S. PATENT DOCUMENTS

| | | | |
|---|---|---|---|
| 2,857,903 | 10/1958 | Watkins | 123/196 CP |
| 3,528,395 | 9/1970 | Goggi | 123/73 R |
| 3,709,202 | 1/1973 | Brown | 123/73 R |
| 3,762,380 | 10/1973 | Schultz | 123/73 R |
| 3,805,751 | 4/1974 | Resnick et al. | 123/73 R |
| 3,859,967 | 1/1975 | Turner et al. | 123/73 A |
| 4,121,551 | 10/1978 | Turner | 123/73 A X |
| 4,181,101 | 1/1980 | Yamamoto | 123/73 A |
| 4,213,431 | 7/1980 | Onishi | 123/73 R |
| 4,359,975 | 11/1982 | Heidner | 123/73 A X |

*Primary Examiner*—W. R. Wolfe

*Attorney, Agent, or Firm*—Andrus, Sceales, Starke & Sawall

[57] ABSTRACT

In a two cycle internal combustion engine (2) wherein heavy fuel ends accumulate in lower portions of the crankcase (8), recirculation means (36, 38) are provided for variably recirculating the heavy fuel ends back into the crankcase only at higher engine speeds for subsequent combustion. The heavy fuel ends are collected in a reservoir (36), and held therein at idle, to minimize engine smoke. The heavy fuel ends are released from the reservoir at higher engine speed for recirculation through a delivery line (40) which is selectively exposed by a throttle valve (24) to crankcase vacuum only at higher engine speed, whereby the heavy fuel ends are sucked from the reservoir through the delivery line and carburetor throat (26) into the crankcase.

10 Claims, 1 Drawing Figure

IDLE FUEL RESIDUAL STORAGE SYSTEM

BACKGROUND AND SUMMARY

In two cycle internal combustion engines, at idle speed, heavy fuel ends condense on the walls of the crankcase and accumulate in the lowest part of the crankcase. Various systems are known for recirculating these heavy fuel ends back into the crankcase for subsequent combustion.

Heavy fuel ends do not burn well, and the recirculated heavy fuel ends tend to cause the engine to smoke at idle.

The present invention addresses and solves the smoking problem by providing a system for recirculating the heavy fuel ends only at higher engine speed. In the preferred embodiment, the heavy fuel ends are saved or collected in a reservoir during idle, and released for recirculation at higher engine speed.

BRIEF DESCRIPTION OF THE DRAWING

The sole drawing FIGURE schematically illustrates an idle fuel residual storage system in accordance with the invention.

DETAILED DESCRIPTION

Figure 1:
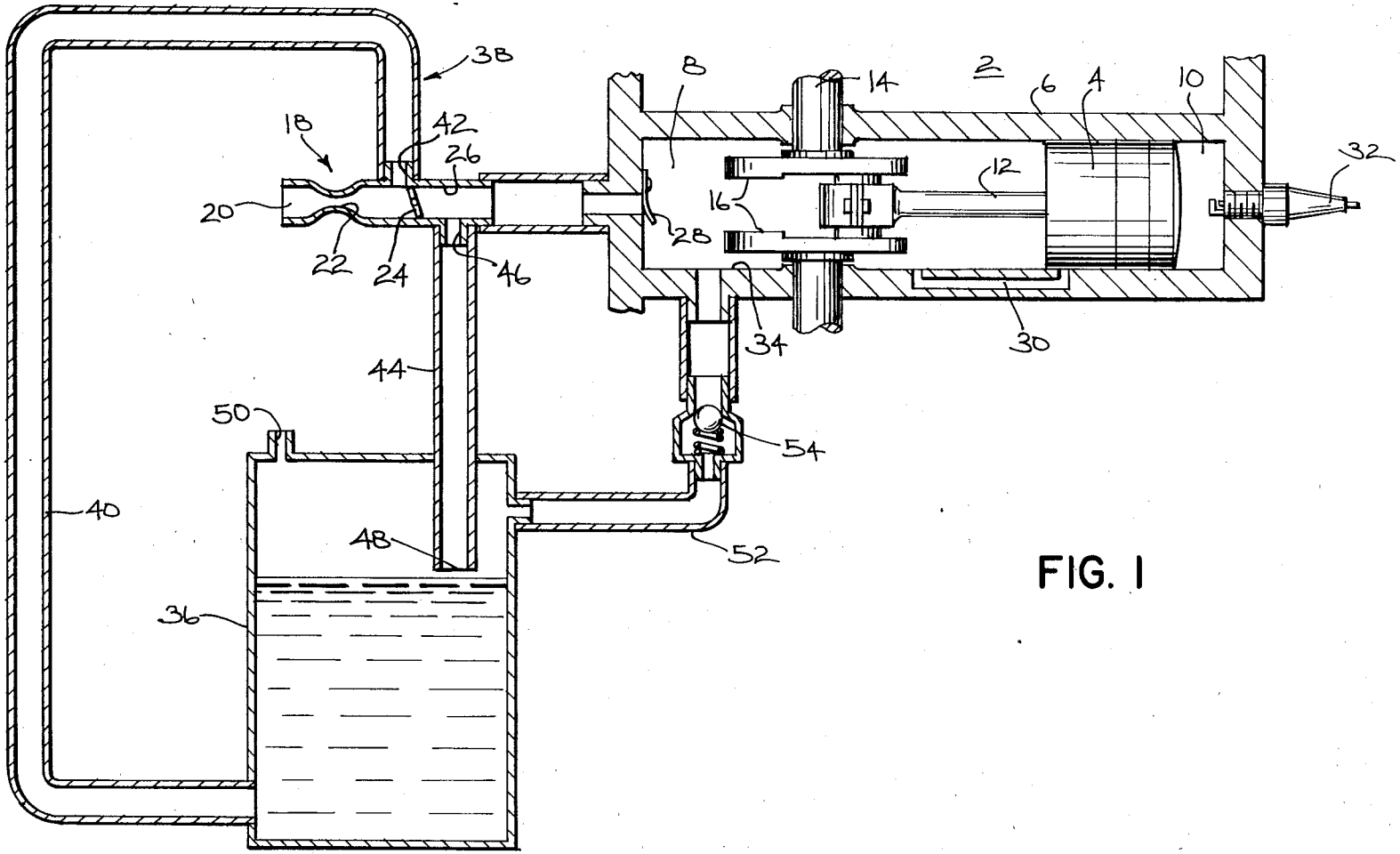

There is shown in the drawing a two cycle internal combustion engine 2 having a piston 4 reciprocal in a cylinder 6 between a crankcase 8 and a combustion chamber 10. The piston connecting rod 12 is shown connected to a vertical crankshaft 14, including counterweights such as 16. Crankcase 8 is typically carbureted or otherwise supplied with fuel, for example fuel supply means 18 having fuel-air intake 20, venturi 22 and throttle valve 24, such as a butterfly valve, in carburetor throat 26 exposed to crankcase vacuum through one-way reed or flap valve 28. One or more fuel-air transfer passages such as 30 deliver fuel-air mixture from crankcase 8 to combustion chamber 10. During the charging stroke of piston 2, fuel-air mixture is compressed in combustion 10, and upon ignition of spark plug 32 combustion of the mixture drives piston 2 leftwardly in the opposite direction to provide the power stroke, and also forcing fuel-air mixture to flow from the crankcase into transfer passage 30 and into combustion chamber 10 for repetition of the cycle. During the charging stroke of the piston, vacuum is created in crankcase 8, and during the power stroke the crankcase is pressurized. Heavy fuel ends tend to accumulate in the lowest portions such as 34 of the crankcase.

A reservoir 36 is connected to the crankcase for receiving and collecting the heavy fuel ends. The power stroke of piston 4 pumps the heavy fuel ends into reservoir 36. Recirculation means 38 is responsive to engine speed for recirculating the heavy fuel ends from reservoir 36 back to crankcase 8 at high engine speed, and preventing such recirculation at idle to minimize engine smoke. Recirculation means 38 includes delivery line 40 connected between reservoir 36 and fuel supply means 18. Delivery line 40 is connected to carburetor throat 26 at nozzle 42 upstream of throttle valve 24 when the latter is closed. Throttle valve 24 controls engine speed between idle, when the throttle valve is closed, and higher speeds as the throttle valve is opened, i.e., rotated counterclockwise. When throttle valve 24 is closed, it blocks application of crankcase vacuum to delivery line 40 at nozzle 42. As throttle valve 24 is opened, it exposes delivery line 40 at nozzle 42 to crankcase vacuum, whereby the heavy fuel ends are sucked from reservoir 36 through delivery line 40 and carburetor throat 26 into crankcase 8 at higher engine speed.

A second delivery line 44 is connected from reservoir 36 to carburetor throat 26 at nozzle 46 downstream of throttle valve 24 to be subjected to crankcase vacuum regardless of throttle valve position. Delivery line 44 has an intake end 48 at a predetermined height in reservoir 36 such that when the level of the heavy fuel ends in the reservoir rise above the predetermined height at 48, the heavy fuel ends are sucked through delivery line 44 and carburetor throat 26 into crankcase 8 regardless of the position of throttle valve 24. This keeps the level in reservoir 36 at or below the predetermined height at 48. The size of the reservoir determines how long the engine can be run at idle without dumping the heavy fuel ends back into the crankcase.

An atmospheric vent 50 is provided in reservoir 36 above the predetermined height at 48 to prevent the reservoir from being pressurized or subject to vacuum. Delivery line 52 connects crankcase 8 through a one-way check valve 54 to reservoir 36 at a point above the predetermined height at 48. One-way valve 54 permits flow of the heavy fuel ends from the crankcase to the reservoir and blocks reverse flow.

The invention thus provides engine speed responsive recirculation means for recirculating heavy fuel ends from the low portions of the crankcase back into the crankcase at high engine speed, and preventing such recirculation at low engine speed below a given value to minimize engine smoke. In the preferred embodiment, the recirculation means is responsive to a throttle valve such as 24. The reciruclation means includes a reservoir 36 and a delivery line 40 operatively controlled by throttle valve 24 such that the delivery line is subjected to crankcase vacuum at high engine speed to recirculate the heavy fuel ends, and such that the throttle valve blocks application of crankcase vacuum to delivery line 40 at idle and the heavy fuel ends are held in reservoir 36.

It is recognized that various alternatives and modifications are possible within the scope of the appended claims.

I claim:

1. In a two cycle internal combustion engine comprising:

a piston reciprocal in a cylinder between a crankcase and a combustion chamber;

means for supplying fuel to said crankcase;

fuel-air transfer passage means between said crankcase and said combustion chamber;

said piston having a charging stroke in one direction compressing fuel-air mixture in said combustion chamber and creating a vacuum in said crankcase, and having a power stroke upon combustion of said mixture driving said piston in the opposite direction pressurizing said crankcase and forcing fuel-air mixture to flow from said crankcase through said transfer passage means to said combustion chamber for repetition of the cycle, and wherein heavy fuel ends accumulate in said crankcase;

the improvement comprising:

reservoir means connected to said crankcase for receiving said heavy fuel ends, said power stroke of said piston pumping said heavy fuel ends into said reservoir means; and means responsive to engine speed for recirculating said heavy fuel ends back to said crankcase at high engine speed, and means blocking said recirculation at idle to minimize engine smoke.

2. The invention according to claim 1 wherein said means responsive to engine speed comprises means connected between said reservoir means and said fuel supply means.

3. In a two cycle internal combustion engine having a piston reciprocal in a cylinder between a crankcase and a combustion chamber and accumulating heavy fuel ends at low portions in said combustion chamber, the improvement comprising engine speed responsive recirculation means for recirculating said heavy fuel ends from said low portions back into said crankcase at high engine speed and means for blocking said recirculation at low engine speed below a given value to minimize engine smoke.

4. The invention according to claim 1 wherein:

said piston has a charging stroke in one direction compressing fuel-air mixture in said combustion chamber and creating a vacuum in said crankcase, and has a power stroke in the opposite direction pressurizing said crankcase; and said recirculation means comprises:

reservoir means connected to said crankcase to collect said heavy fuel ends pumped into said reservoir means during said power stroke;

delivery line means connected to said reservoir means; and means for subjecting said delivery line means to said crankcase vacuum at high engine speed and preventing application of said crankcase vacuum to said delivery line means at engine idle, whereby said heavy fuel ends from said reservoir means are sucked into said crankcase by said crankcase vacuum only at said high engine speed, and said heavy fuel ends are held in said reservoir means at engine idle.

5. The invention according to claim 3 comprising fuel supply means connected to said crankcase and having throttle valve means for controlling engine speed, and wherein said recirculation means is responsive to said throttle valve means.

6. The invention according to claim 5 wherein said recirculation means includes reservoir means connected to said crankcase for collecting said heavy fuel ends, and delivery line means connected to said reservoir means and operatively controlled by said throttle valve means to recirculate said heavy fuel ends back to said crankcase at high engine speed, and to hold said heavy fuel ends in said reservoir means, without said recirculation, at idle.

7. In a two cycle internal combustion engine comprising:

a piston reciprocal in a cylinder between a crankcase and a combustion chamber;

means for supplying fuel to said crankcase;

fuel-air transfer passage means between said crankcase and said combustion chamber;

said piston having a charging stroke in one direction compressing fuel-air mixture in said combustion chamber and creating a vacuum in said crankcase, and having a power stroke upon combustion of said mixture driving said piston in the opposite direction pressurizing said crankcase and forcing fuel-air mixture to flow from said crankcase through said transfer passage means to said combustion chamber for repetition of the cycle, and wherein heavy fuel ends accumulate in said crankcase;

the improvement comprising:

reservoir means connected to said crankcase for receiving said heavy fuel ends, said power stroke of said piston pumping said heavy fuel ends into said reservoir means; and means responsive to engine speed for recirculating said heavy fuel ends back to said crankcase at high engine speed, and preventing said recirculation at idle to minimize engine smoke;

wherein said means responsive to engine speed comprises means connected between said reservoir means and said fuel supply means;

wherein said fuel supply means comprises a carburetor throat with a throttle valve controlling engine speed between idle when said throttle valve is closed and higher speeds as said throttle valve is opened, and comprising delivery line means connected from said reservoir means to said carburetor throat upstream of said throttle valve in said closed position such that at idle said throttle valve blocks said delivery line from application of crankcase vacuum during said charging stroke, opening of said throttle valve exposing said delivery line to crankcase vacuum whereby said heavy fuel ends are sucked from said reservoir means through said delivery lines means and said carburetor throat into said crankcase at higher engine speed.

8. The invention according to claim 7 comprising a second delivery line connected from said reservoir means to said carburetor throat downstream of said throttle valve to be subjected to crankcase vacuum regardless of throttle valve position, said second delivery line having an intake end at a predetermined height in said reservoir means such that when the level of said heavy fuel ends in said reservoir means is above said predetermined height said heavy fuel ends are sucked through said second delivery line and said carburetor throat into said crankcase regardless of throttle valve position, whereby to keep the level in said reservoir means at or below said predetermined height.

9. The invention according to claim 8 comprising vent means in said reservoir means above said predetermined height to prevent said reservoir means from being pressurized or subject to vacuum.

10. The invention according to claim 9 comprising means connecting said crankcase through one-way valve means to said reservoir means at a point above said predetermined height.

* * * * *